US005701618A

United States Patent [19]

Brugger

[11] Patent Number: 5,701,618

[45] Date of Patent: Dec. 30, 1997

[54] HYDRAULIC SYSTEM FOR HYDRAULICALLY ACTUATING AN AMBULANCE LIFTING TABLE

[76] Inventor: Klaus Brugger, Max-Josef-Strasse 2, 83684 Tegernsee, Germany

[21] Appl. No.: 632,482

[22] PCT Filed: Nov. 10, 1994

[86] PCT No.: PCT/EP94/03724

§ 371 Date: Apr. 24, 1996

§ 102(e) Date: Apr. 24, 1996

[87] PCT Pub. No.: WO95/13043

PCT Pub. Date: May 18, 1995

[30] Foreign Application Priority Data

Nov. 11, 1993 [DE] Germany ..... 9317308 U

[51] Int. Cl.[6] ..... A61G 7/05; A61G 3/00

[52] U.S. Cl. ..... 5/611; 5/614; 254/93 R

[58] Field of Search ..... 5/611, 614; 108/147; 296/19, 20; 254/93 R

[56] References Cited

U.S. PATENT DOCUMENTS 4,078,269 3/1978 Weipert ..... 5/611

FOREIGN PATENT DOCUMENTS 0190782 8/1986 European Pat. Off. .

2538411 3/1977 Germany .

2816564 10/1979 Germany .

*Primary Examiner*—Alexander Grosz

*Attorney, Agent, or Firm*—Wolf, Greenfield & Sacks P.C.

[57] ABSTRACT

A hydraulic system for hydraulically actuating a vertically adjustable ambulance lifting table used for receiving thereon a stretcher and adapted to be selectively switched to a cushioned mode of operation comprises a cylinder for actuating the lifting table, a hydraulic accumulator for cushioning the lifting table, a pump, a three-way valve, and a discharge valve connected to a reservoir of the hydraulic system on the outlet side thereof. In order to prevent the patient and/or the medical personnel from being exposed to danger by the lifting table when the above-mentioned hydraulic system is used, and even if the hydraulic system is actuated incorrectly, the three-way valve is in fluid connection with the pump and the hydraulic accumulator on the inlet side thereof and with the cylinder on the outlet side thereof, a valves is provided between the cylinder on the one hand and the hydraulic accumulator on the other, the valves is controlled such that it assumes an open position only if the pressure in the hydraulic accumulator exceeds the pressure within the cylinder by not more than a predetermined pressure difference, and the input side of the discharge valve is in fluid connection either with the hydraulic accumulator or with the cylinder depending on the pressure prevailing in the hydraulic accumulator relative to the pressure prevailing in the cylinder.

12 Claims, 1 Drawing Sheet

HYDRAULIC SYSTEM FOR HYDRAULICALLY ACTUATING AN AMBULANCE LIFTING TABLE

FIELD OF THE INVENTION

The present invention refers to a hydraulic system for hydraulically actuating an ambulance lifting table. In particular, the present invention deals with a hydraulic system for hydraulically actuating a vertically adjustable ambulance lifting table used for receiving thereon a stretcher and adapted to be selectively switched to a cushioned mode of operation, said hydraulic system comprising a cylinder for actuating the lifting table, a hydraulic accumulator for cushioning the lifting table, a pump, a three-way valve, and a discharge valve means connected to a reservoir on the outlet side thereof.

DESCRIPTION OF THE PRIOR ART

It has been known for a fairly long time to hydraulically actuate hydraulically the lifting table which is used for receiving thereon a stretcher in an ambulance. The hydraulic system for hydraulically actuating the lifting table must fulfill a plurality of requirements so as to permit treatment of a patient at a so-called shock position, at which the table is secured in position at its top or bottom dead centre, within the ambulance, or so as to obtain a cushioned support of the table at a central position of the cylinder. The requirements which have to be fulfilled by such a hydraulic system include, as will be shown by the explanations following hereinbelow, also strict safety specifications which are intended to prevent the patient from being harmed even if the hydraulic system for the hydraulic actuation of the lifting table is actuated incorrectly.

In the known hydraulic system of the type mentioned at the beginning, the hydraulic accumulator is connected directly to the cylinder and can be blocked by a pressure-independent 2/2-way valve. This known hydraulic system can be operated incorrectly in different ways or it may happen that technical defects occur, which may cause danger to the patient and the medical personnel in the ambulance. It is, for example, imaginable that the patient who first lies on the stretcher is very heavy and that, when the patient has been moved, the lifting table is lowered down to its bottom dead centre prior to removing the stretcher from the lifting table. If, during this lowering operation, the residual pressure is not fully discharged because of a technical defect, e.g. because of an electrical disconnection, a high pressure corresponding to the heavy weight of said patient will still prevail in the hydraulic accumulator. If the next patient who is placed on the lifting table on a stretcher is not heavy and if the fluid connection to the lifting cylinder is opened by pressing the "lift" button, the high pressure, which is still stored in the hydraulic accumulator, will cause the lifting table to move abruptly upwards. It need not be explained in detail that, especially in the case of patients with back injuries, jerky operations of the lifting table must not be permitted under any circumstances. For eliminating this kind of problem, it has already been suggested to provide the hydraulic accumulator with a manometer so that the ambulance attendant or some other operator can recognize a dangerous high pressure in the hydraulic accumulator. Taking into account the hectic kind of daily work which has to be done by emergency medical personnel when they are on duty, it cannot be expected that the emergency medical personnel will actually check the manometer display prior to each actuation of the lifting table.

A dangerous pressure difference between the hydraulic accumulator and the lifting cylinder will also be generated if a patient or an operator leaves the table in the blocked condition of the cushioning system. If some type of adjusting knob is now actuated, the table will inevitably move upwards abruptly. This movement can be so violent that acute danger may even be caused to persons who stand or sit in the vicinity of the table and who touch the table with a part of their body. If, due to a technical defect, the table is discharged by a hand-operated emergency discharge valve, it depends on the operator how long he maintains said hand-operated emergency discharge valve open, when the table has arrived at its lower position, so as to reduce the residual pressure in the hydraulic accumulator, a process which may require up to 10 seconds' time. If the table with the stretcher is now removed from the vehicle and the patient is unloaded, the table will either move abruptly upwards during the unloading operation or the next patient who is less heavy than the preceding one will be catapulted upwards, depending on whether the hydraulic accumulator is non-current-carrying and blocked or open.

DE-A-2538411 already discloses a hydraulic system used for hydraulically actuating an ambulance lifting table and comprising a cylinder for actuating the lifting table, a hydraulic accumulator in the form of an expansion tank, a pump and a valve means. A sharp-off valve is provided between the hydraulic accumulator and the cylinder, for arresting the cushioning of the ambulance lifting table; also provided is a non-return valve that is arranged in parallel with a plate orifice. This known system also has the disadvantages and risks discussed hereinbefore. If the shut-off valve is blocked in a condition in which a high load is applied to the ambulance lifting table, a high pressure will continue to exist in the hydraulic accumulator. If the shut-off valve is re-opened in this condition for initiating the cushioned mode of operation of the ambulance lifting table, the ambulance lifting table will carry out an abrupt upward movement. This abrupt upward movement of the table may involve danger to patients and to the ambulance attendants, which has been explained hereinbefore.

SUMMARY OF THE INVENTION

Taking this prior art as a basis, it is therefore the object of the present invention to further develop the hydraulic system, which is used for hydraulically actuating an ambulance lifting table and which has been mentioned at the beginning, in such a way as to reduce danger to the patient and/or the medical personnel by the movement of the lifting table, if the hydraulic system is actuated incorrectly.

This object is achieved by a hydraulic system for hydraulically actuating a vertically adjustable ambulance lifting table used for receiving thereon a stretcher and adapted to be selectively switched to a cushioned mode of operation, said hydraulic system comprising:

- a cylinder for actuating the lifting table,
- a hydraulic accumulator for cushioning the lifting table,
- a pump,
- a three-way valve in fluid connection with the pump and the hydraulic accumulator on the inlet side thereof and with the cylinder on the outlet side thereof, the three-way valve limiting the amount of fluid that can be supplied to the cylinder,
- a discharge valve means connected to a reservoir of the hydraulic system on the outlet side thereof, the discharge valve means being connected to the hydraulic accumulator on its input side, and a valve means provided between the cylinder on the one hand and the hydraulic accumulator on the other, said valve means being controllable such that it assumes an open position only if the pressure in the hydraulic accumulator exceeds the pressure within the cylinder by not more than a predetermined pressure difference.

SHORT DESCRIPTION OF THE DRAWINGS

In the following, a preferred embodiment of the hydraulic system according to the present invention will be explained in detail with reference to the drawing enclosed, in which:

FIG. 1 shows a connection diagram of the hydraulic system according to the preferred embodiment of the present invention.

DESCRIPTION OF THE PREFERRED EMBODIMENTS OF THE INVENTION

Figure 1:
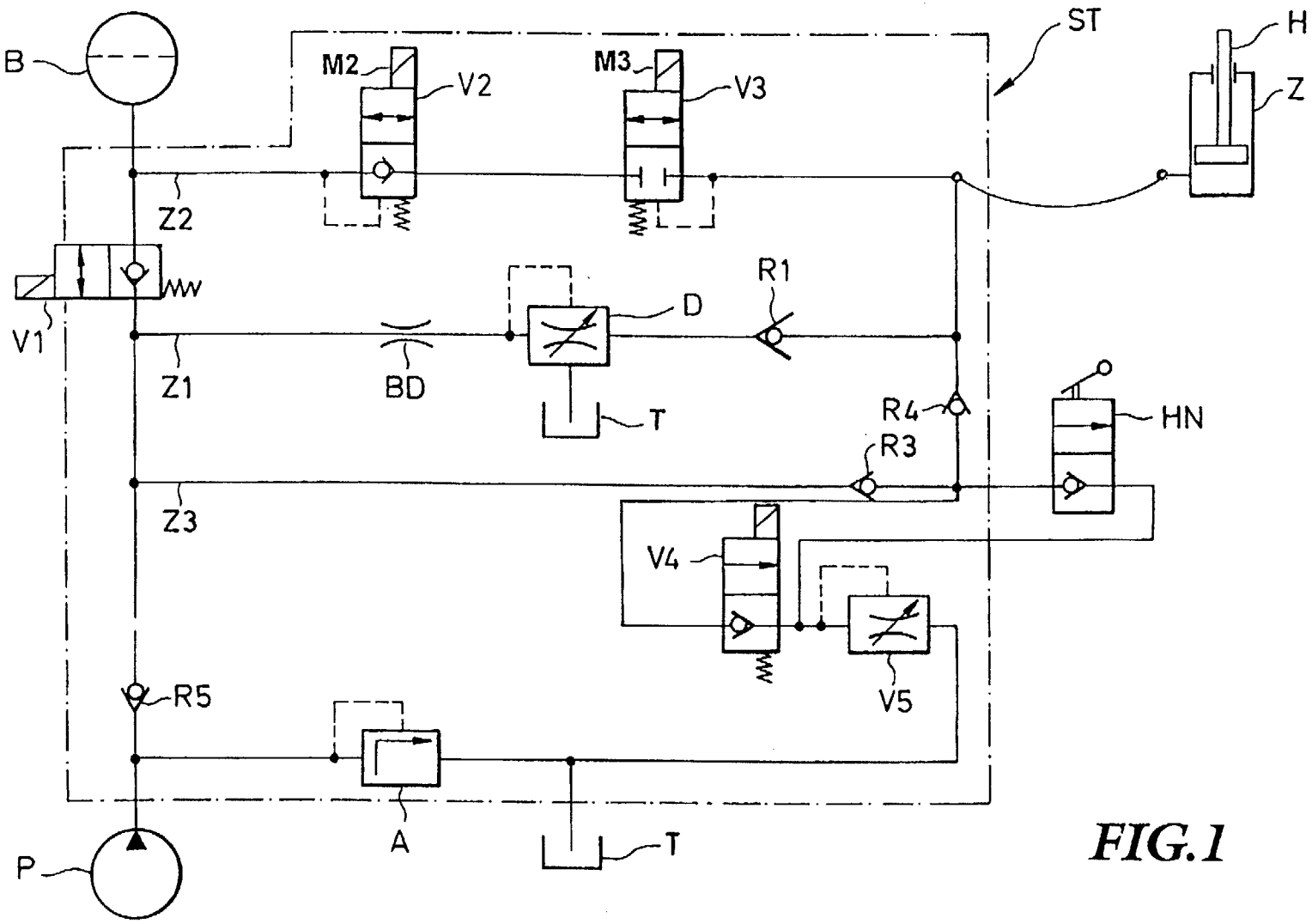

As can be seen in the FIG. 1, the hydraulic system according to the present invention, which serves to hydraulically actuate a vertically adjustable ambulance lifting table H used for receiving thereon a stretcher (not shown) and adapted to be selectively switched to a cushioned mode of operation, comprises a cylinder Z for actuating said lifting table H, a hydraulic accumulator B for cushioning the lifting table, a pump P for supplying the hydraulic fluid, and a hydraulic control system, which is arranged between these components of the system and a reservoir T and which is designated generally by reference numeral ST.

In a first branch Z1 of the hydraulic system, which extends between the hydraulic accumulator B and the cylinder Z, an orifice plate BD is positioned, which is used for producing a pressure drop depending on the flow rate of the fluid flowing to the cylinder Z, a three-way-valve D for limiting the amount of fluid which can be supplied to the cylinder Z to e.g. approx. 0.7 l/min, and a first non-return valve R1, which can be opened only in the direction of the cylinder Z and which is spring-loaded by means of a spring F (not shown) in a direction opposite to its opening direction so that it can only be opened when the pressure prevailing in the hydraulic accumulator B is above the cylinder pressure of approx. 1 bar. The pressure difference determined by this spring F is adapted to the pressure loss occurring in the hydraulic accumulator B, when the pressure in said hydraulic accumulator has been raised to a specific operating pressure starting from 0 pressure, whereby the gas is heated in the hydraulic accumulator B, the subsequent cooling down of said gas causing the pressure difference which is to be compensated for by said spring F.

In a second branch Z2, which is parallel to said first branch Z1 and which extends between the cylinder Z and the hydraulic accumulator B, a valve means is located, which comprises a second valve V2 connected in series with a third valve V3, said valves being not pressure compensated. The third valve V3 permits small leakage in both directions.

Between said first branch Z1 and said second branch Z2, a first valve V1 is located.

For reasons which will be explained hereinbelow, the valve V2 is constructed such that it can only be moved to its open position if the pressure applied to its connection facing the hydraulic accumulator exceeds the pressure applied to its connection facing away from the hydraulic accumulator by not more than a predeterminable pressure difference. The operating advantages which can thus be achieved will be discussed in connection with the explanation of the function of the system.

Also the valve V3 can only be opened if the pressure in the cylinder Z exceeds the pressure on the side of the hydraulic accumulator by not more than a predetermined difference.

The hydraulic series connection of a non-return valve R3, a fourth valve V4 and a two-way controller V5, which limits the discharge flow rate of the hydraulic flow from the hydraulic accumulator B into the reservoir T, is located in a third branch Z3 extending between the hydraulic accumulator B and the reservoir T. The fourth valve V4 is connected to a common junction of a third and a fourth non-return valve R3, R4 so that the respective higher pressure in the hydraulic accumulator B and the cylinder Z, respectively, can first be reduced.

The third and the fourth non-return valve R3, R4, each of which can only be opened in the direction of a hand-operated emergency valve HN, are located between the hydraulic accumulator B on the one hand or the cylinder Z on the one hand and said hand-operated emergency valve HN on the other. The outlet of the hand-operated emergency valve HN is connected to the inlet of the two-way valve V5.

Finally, a fifth non-return valve R5, which can be opened only in the direction of the hydraulic accumulator B, is located between the pump P and the hydraulic accumulator B. A fixedly set pressure-limiting valve A is located between the pump P and the reservoir T.

In the following, the mode of operation of the system shown in the figure will be explained. The valves are shown in the figure in a non-current-carrying condition.

Taking as a basis an initial position of the lifting table H at the bottom dead centre thereof, the pump P as well as the first valve V1 and the second valve V2 have a current supplied thereto for lifting the lifting table. Initially, the pump P pumps the fluid into the hydraulic accumulator. When the pressure required for lifting the cylinder Z has been reached, the cylinder will be accelerated continuously and slowly depending on the total flow resistance in branch Z1 until it has reached its maximum speed depending on the properties of the three-way valve D. In the course of this process, the pressure in the hydraulic accumulator exceeds the pressure in the cylinder Z by an amount corresponding to the flow resistance in branch Z1. The amount of fluid delivered by the pump P must be larger than the maximum amount of fluid flowing through the three-way valve D. It follows that a constant lifting movement is carried out until the pump P is switched off. The excessive amount delivered will be discharged in the three-way valve D into the reservoir T.

A short time before the desired level of the lifting table cylinder Z has been reached, the pump is switched off. A short time afterwards, the first valve V1 is switched off. The second valve V2 is a valve which is not pressure compensated and which, starting from its closed position, cannot be opened as long as the pressure in the hydraulic accumulator exceeds the pressure in the lifting table cylinder by a predetermined relative differential pressure amount.

Exactly the opposite is the case for the valve V3. If the pressure in the cylinder Z is higher than the pressure on the side of the hydraulic accumulator, said valve V3 cannot be opened. Hence, the table is also prevented from falling down.

When the lifting table has been pumped to the desired position, viz. e.g. to the cushioned central position, the pump P will be switched off. In this situation, a continuous deceleration of the lifting table H is achieved by the decreasing amount of fluid flowing through the orifice plate BD and the three-way valve D until said lifting table stops at its end position. It follows that, instead of jerky switching off, the lifting movement fades away continuously. When the table has come to a standstill, the first valve V1 is closed.

When the lifting table H has been raised to its central position and come to an standstill, current can be supplied to the two valves V2 and V3 so that the table can yield. If the table has to be locked in position, e.g. for reviving a patient, the second and third valves V2, V3 are switched off simultaneously. In this locked condition, which is determined by the second and third valves V2, V3, it may happen that the load acting on the lifting table H suddenly decreases, if, for example, a person leaves the lifting table H or if a patient is picked up from said lifting table H. In order to prevent abrupt rising or lowering of the table in response to an activation of the cushioning which may now occur, the valve V3 has the property of leaking. This has the effect that the actual pressure in the cylinder Z is reported to the valve V2. Said valve V2 will only open if the pressure is approximately balanced. Uncontrolled upward movements of the table will thus be avoided. If the pressure on the side of the cylinder is higher, the third valve V3 will not open so that abrupt dropping of the table will be prevented.

For lowering the lifting table H, the valves V2, V3 and V4 have current supplied thereto. The table starts to move downwards with a pleasant slow movement, if there is no substantial difference between the pressures in the cylinder and in the hydraulic accumulator. If the pressure is higher on the cylinder side, the cylinder Z will first be lowered whereupon the hydraulic accumulator B will be emptied, since, when the lowermost position has been reached, the valve V4 has still current supplied thereto for a period of approx. 10 seconds. If the pressure in the hydraulic accumulator B is higher, fluid will first be discharged from said hydraulic accumulator. Also if the pressures are equal, the cylinder will be lowered. When the central position is reached during the table lowering movement from the uppermost position, it is first only the valve V4 that is closed, whereas the connection via the valves V2 and V3 is still kept open for a short period of time so that the table will be stopped in a manner which is agreeable to the patient.

If, e.g. due to the fact that a patient has been removed from the lifting table H, the hydraulic accumulator pressure should, in this condition, be higher than the pressure of the cylinder Z, the hydraulic accumulator will first be emptied via the fourth valve V4 and the two-way valve V5 until the pressure in the lifting cylinder is equal to the pressure in the hydraulic accumulator so that the fluid can flow via the valves V2 and V3 and so that also the lifting cylinder will be lowered.

When the hand-operated emergency valve is actuated, also this will have the effect that the pressure is first reduced in that area of the hydraulic accumulator B and of the lifting cylinder Z, respectively, which has the higher pressure at the moment in question, until pressure adaptation has been effected.

According to an essential aspect of the present invention, the second and third valves V2, V3 can be connected in series as far as the supply of current is concerned. In other words, this aspect according to the present invention discloses that the second and third valves V2, V3 are provided with solenoids M2, M3, which are electrically connected in series, for their actuation. This has the effect that the power consumption of the current taken from the vehicle battery is reduced by three quarters in the condition in which the cushioning is switched on. Due to the low power consumption of the second and third valves V2, V3, which is achieved by the series connection, it is here also possible to use versions which are open when no current is supplied, since power consumption can then only take place in the closed condition of the second and third valves V2, V3, which causes the cushioned mode of operation of the lifting table H.

The non-return valves R3, R4 are spring-loaded. Preferably, the spring preload of the fourth non-return valve R4 exceeds the spring preload of the third non-return valve R3 in such a way that the fourth non-return valve R4 opens at a pressure exceeding the opening pressure of the third non-return valve R3 by 0.1 to 0.5 bar.

I claim:

1. A hydraulic system for hydraulically actuating a vertically adjustable ambulance lifting table used for receiving thereon a stretcher and adapted to be selectively switched to a cushioned mode of operation, said hydraulic system comprising:

a cylinder for actuating the lifting table, a hydraulic accumulator for cushioning the lifting table, a pump, a three-way valve in fluid connection with the pump and the hydraulic accumulator on the inlet side thereof and with the cylinder on the outlet side thereof, the three-way valve limiting the amount of fluid that can be supplied to the cylinder, a discharge valve means connected to a reservoir of the hydraulic system on the outlet side thereof, the discharge valve means being connected to the hydraulic accumulator on its input side, and a valve means provided between the cylinder on the one hand and the hydraulic accumulator on the other, said valve means being controllable such that it assumes an open position only if the pressure in the hydraulic accumulator exceeds the pressure within the cylinder by not more than a predetermined pressure difference.

2. A hydraulic system according to claim 1, wherein the input side of the discharge valve means is additionally adapted to be connected to the cylinder.

3. A hydraulic system according to claim 1, wherein the input side of the discharge valve means is in fluid connection either with the hydraulic accumulator or with the cylinder depending on the pressure prevailing in the hydraulic accumulator relative to the pressure prevailing in the cylinder.

4. A hydraulic system according to claim 1, further comprising a first non-return valve arranged in series with the three-way valve in such a way that it can only be opened for a flow of fluid in the direction of the cylinder.

5. A hydraulic system according to claim 1, further comprising an orifice plate which is connected in series with the three-way valve.

6. A hydraulic system according to claim 1, further comprising a first valve which is connected between the hydraulic accumulator and the three-way valve.

7. A hydraulic system according to claim 1, wherein the valve means comprises a second valve connected in series with a third valve, said valves being not pressure compensated, and the third valve permits small leakage in both directions.

8. A hydraulic system according to claim 7, wherein the second and third valves are provided with solenoids which are electrically connected in series.

9. A hydraulic system according to claim 1, wherein the discharge valve means comprises a fourth valve and a two-way valve, which is connected in series with said fourth valve, for determining a discharge flow amount.

10. A hydraulic system according to claim 9, further comprising a hand-operated emergency valve whose input side is connected to the cylinder via a fourth non-return valve and to the hydraulic accumulator via a third non-return valve and whose output side is connected to the input of the two-way valve.

11. A hydraulic system according to claim 9, wherein the fourth valve is connected to a common junction of the third and fourth non-return valves so that the respective higher pressure in the hydraulic accumulator and the cylinder, respectively, can first be reduced.

12. A hydraulic system according claim 11, wherein the fourth non-return valve has a spring preload which exceeds a spring preload of the third non-return valve in such a way that the fourth non-return valve opens at a pressure exceeding the opening pressure of the third non-return valve by 0.1 to 0.5 bar.

* * * * *